US005330208A

United States Patent [19]

Charron et al.

[11] Patent Number: 5,330,208

[45] Date of Patent: Jul. 19, 1994

[54] SHOCK ABSORBENT IN-LINE ROLLER SKATE

[76] Inventors: Francois E. Charron, P.O. Box 169, Suite 101 - 1184 Denman Street, Vancouver, British Columbia, Canada, V6G 2M9; Gerald O. S. Oyen, #480 - 601 West Cordova Street, Vancouver, British Columbia, Canada, V6B 1G1

[21] Appl. No.: 50,819

[22] Filed: Mar. 22, 1993

[51] Int. Cl.[5] ..... A63C 17/04

[52] U.S. Cl. ..... 280/11.22; 380/11.27; 380/11.28

[58] Field of Search ..... 280/11.19, 11.2, 11.22, 280/11.27, 11.28, 87.04, 87.042

[56] References Cited

U.S. PATENT DOCUMENTS

| | | | |
|---|---|---|---|
| 1,609,612 | 12/1926 | Eskeland | 280/11.22 |
| 1,616,952 | 2/1927 | Dahl | 280/11.22 |
| 2,644,692 | 7/1953 | Kahlert | 280/11.22 |
| 3,880,441 | 4/1975 | Silver | 280/11.22 |
| 4,909,523 | 3/1990 | Olson | 280/11.22 |
| 4,915,399 | 4/1990 | Marandel | 280/11.28 |
| 5,092,614 | 3/1992 | Malewicz | 280/11.22 |
| 5,190,301 | 3/1993 | Malewicz | 280/11.22 |

*Primary Examiner*—Richard M. Camby

[57] ABSTRACT

This invention is directed to in-line roller skates. More particularly, this invention pertains to shock absorbent in-line roller skates wherein the wheels are resilient mounted to navigate over rough, bumpy surfaces. An in-line roller skate comprising: (a) a boot adapted to receive a foot of a skater; (b) a first wheel supporting rail means secured to an underside of the boot; (c) a second wheel supporting rail means secured to an underside of the boot, adjacent the first rail; (d) at least three wheel means mounted in a line in association with the first and second rail means, the three wheel means being respectively connected to the first and second rail means by respective axles and bearings; and (e) resilient shock absorbing means located between the axle and bearing means and the rail means to enable the respective three wheel means to move upwardly or downwardly relative to the first and second rail means.

16 Claims, 10 Drawing Sheets

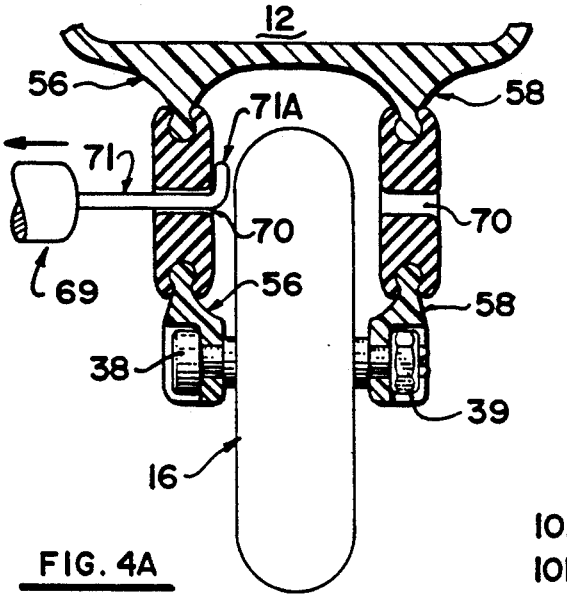
FIG. 4A
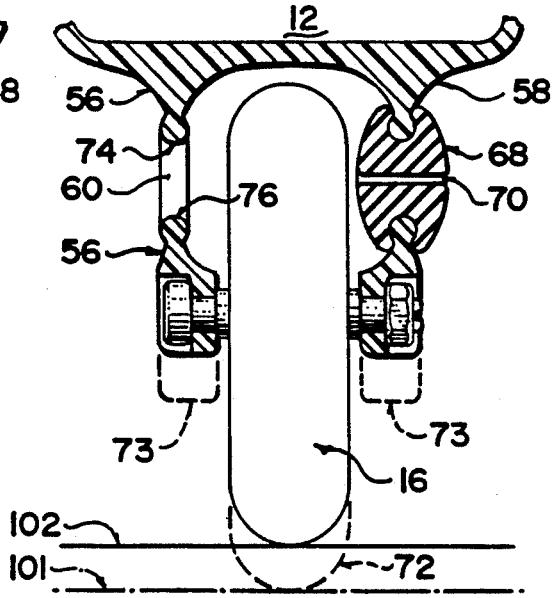
FIG. 4B
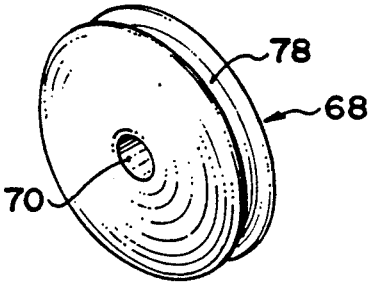
FIG. 4F
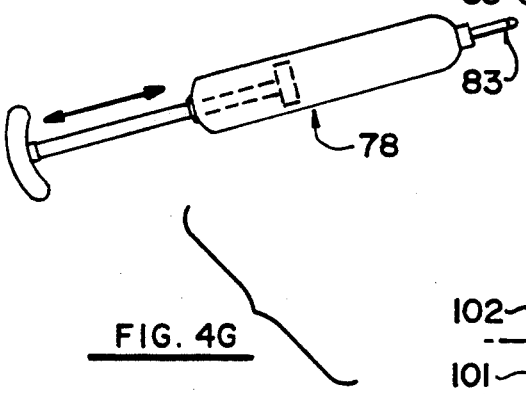
FIG. 4G
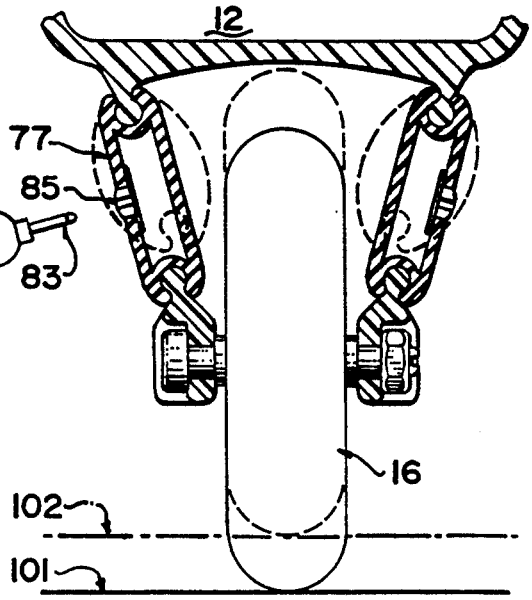

SHOCK ABSORBENT IN-LINE ROLLER SKATE

FIELD OF THE INVENTION

This invention is directed to in-line roller skates. More particularly, this invention pertains to shock absorbent in-line roller skates wherein the wheels are resilient mounted to navigate over rough, bumpy surfaces.

BACKGROUND OR THE INVENTION

In-line roller skates have become very popular with the public in the past few years. However, the in-line roller skates that are available on the market have a number of inherent limitations. For one thing, the wheels and axles are rigidly mounted to the wheel assembly under the boot and there is no shock absorbing capacity built into the wheels. Accordingly, it is difficult for a person wearing conventional in-line roller skates to skate over uneven or bumpy surfaces.

U.S. Pat. No. 4,915,399, Merandel, granted Apr. 10, 1990 discloses a front and rear -wheel roller skate design which has a suspension system on the front and rear wheels. The roller skate is equipped at the level of the front and rear pivoting axles, with a suspension system for damping shocks resulting from unevenness of a skating surface. The front and rear pivoting axles are each provided with a suspension system which is fixed at one end on the central part of the pivoting axle, and at the other end being guided by a centring barrel located inside a base of the skate. The pivoting axles are also each equipped with a pivoting system secured at one end to the base by a pivoting device while the other end is secured to an arm of the central part by resilient washers. Marandel does not disclose in-line roller skates. He discloses conventional roller skates with a pair of wheels on a front axle and a pair of wheels on a rear axle.

U.S. Pat. No. 5,092,614, Malewicz, assigned to Rollerblade, Inc., granted Mar. 3, 1992, discloses a lightweight in-line roller skate frame and frame mounting system. The in-line roller skate has a frame including a pair of side rails, each side rail having front and rear mounting brackets for attachment of the frame to the boot of the in-line roller skate. Each frame side rail includes a curved portion and a planar portion. The planar portion carries a plurality of axle apertures through which an axle for a wheel may be inserted. Preferably, the axle apertures are configured to receive an axle aperture plug, have an eccentrically disposed axle bore and are situated on the frame side rails such that the wheels may be mounted at multiple relative heights to each other. Malewicz does not disclose any shock absorbing mechanism for the in-line wheels, or any ability for the wheels to move upwardly or downwardly in order to recede when the wheels impact a bump or obstruction.

SUMMARY OF THE INVENTION

An in-line roller skate comprising: (a) a boot adapted to receive a foot of a skater; (b) a first wheel supporting rail means secured to an underside of the boot; (c) a second wheel supporting rail means secured to an underside of the boot, adjacent the first rail; (d) at least three wheel means mounted in a line in association with the first and second rail means, the three wheel means being respectively connected to the first and second rail means by respective axles and bearings; and (e) resilient shock absorbing means located between the axle and bearing means and the rail means to enable the respective three wheel means to move upwardly or downwardly relative to the first and second rail means.

In the roller skate as disclosed the first and second rail means can be unitarily constructed. The three wheel means can be rotationally mounted between the first rail means and the second rail means. In the roller skate, the resilient shock absorbing means can be mounted in a cavity formed in the rail means.

A roller skate as disclosed wherein at least three spring cavity means are formed in the first rail means and at least three cavity means are formed in the second rail means, the cavity means coinciding with the positions of the three wheel means respectively, each cavity means being adapted to receive resilient shock absorbing means.

A roller skate as disclosed wherein the resilient shock absorbing means are compression coil springs which are positioned in the cavity means in the first rail means and second rail means, the coil spring means impinging on the axle and bearing means for each respective wheel means, and absorbing compression force when the respective wheel means moves upwardly, and dispensing compression force when the respective wheel means moves downwardly.

In the roller skate, the first rail means and the second rail means can have formed therein, in association with the respective cavity means, axle wells, which permit the axles to move upwardly or downwardly in relation to the first and second rail means.

An in-line dual wheel roller skate comprising: (a) a boot adapted to receive a foot of a skater; (b) a resilient wheel supporting means secured to the underside of the boot; (c) at least one pair of wheels mounted on the wheel support means in dual relationship with one another, the dual wheels being moveable relative to the boot when a force is exerted on the wheels thereby flexing the wheel supporting means.

In the roller skate as disclosed wherein the dual wheels can be rotationally mounted on either side of the wheel supporting means by a laterally extending axle, the axle being adapted to pivot upwardly or downwardly in relation to the boot by compressing the wheel supporting means. The wheel supporting means can have positioned therein, at least one resilient spring plug which enables the wheels to move upwardly or downwardly relative to the boot.

In the roller skate as disclosed wherein the wheel support means can have formed therein a cavity which is adapted to receive a coil spring, the coil spring impinging upon the axle means and enabling the axle means to move upwardly or downwardly in relation to a force exerted upwardly or downwardly on the dual wheels and the axle.

An in-line roller skate comprising: (a) a boot adapted to receive a foot of a skater; (b) a resilient yoke-like wheel supporting means secured to an underside of the boot, the supporting means having forward extending and rearward extending fork-like arms; and (c) a plurality of wheels rotatably arranged within the fork-like arms of the wheel support means;

In the roller skate as disclosed, a pair of wheels can be arranged in line between the forward fork-like arm, and a pair of wheels can be arranged between the rearward fork-like arm, and the wheels and arms move upwardly when the wheels are placed on the ground.

An in-line roller skate comprising: (a) a boot adapted to receive a foot of a skater; (b) a resilient wheel mounting means secured to the underside of the boot, longitudinal with the boot, and having an elongated longitudinal wheel receiving cavity therein; with at least one opening formed in the side wall of the wheel mounting means; (c) a plurality of wheels rotatably mounted in series within the wheel receiving cavity; and (d) a removable resilient compression force absorbing means fitted in the opening in the wheel mounting means.

A roller skate as disclosed wherein an opening is formed in each wall of the wheel mounting means on either side of the wheel receiving cavity, and the openings are adapted to receive a plurality of detachable resilient compression absorbing means.

In the roller skate as disclosed, wherein the detachable resilient compression receiving means can be formed in the shape of discs which have a peripheral groove around the circumference thereof, the peripheral groove being adapted to fit with the edges of the opening. The discs can be hollow and filled with air or fluid. The air pressure can be adapted by valve and pump means.

In the roller skate, each wall of the wheel mounting means can have formed therein a plurality of openings, each opening receiving a pair of resilient disc-like compression absorbing means. The disc-like resilient compression force absorbing means can have compressible openings therein.

In the roller skate, the wheels can have rotatable bearings therein and can be mounted on axles which are secured to the side walls if the wheel supporting means. A roller skate as disclosed wherein a pair of disc-like resilient compression absorbing means are detachably fitted to the wheel mounting means for every axle.

BRIEF DESCRIPTION OF THE DRAWINGS

In the drawings which represent specific embodiments of the invention but which should not be regarded as restricting the spirit or scope of the invention in any way:

FIG. 4A illustrates a section view taken along section line 4A—4A of FIG. 4.

FIG. 4B illustrates a variation of a section view taken along section line 4A—4A of FIG. 4 when the roller wheel is reacting to upward compression, and a disc is on one side only.

FIG. 4F, which appears on the same sheet as FIGS. 4A and 4B, illustrates a perspective view of a resilient shock absorbent spring plug.

FIG. 4G illustrates a partial section view of a sixth embodiment of the invention with air filled discs.

DETAILED DESCRIPTION OF SPECIFIC EMBODIMENTS OF THE INVENTION

Figure 1:
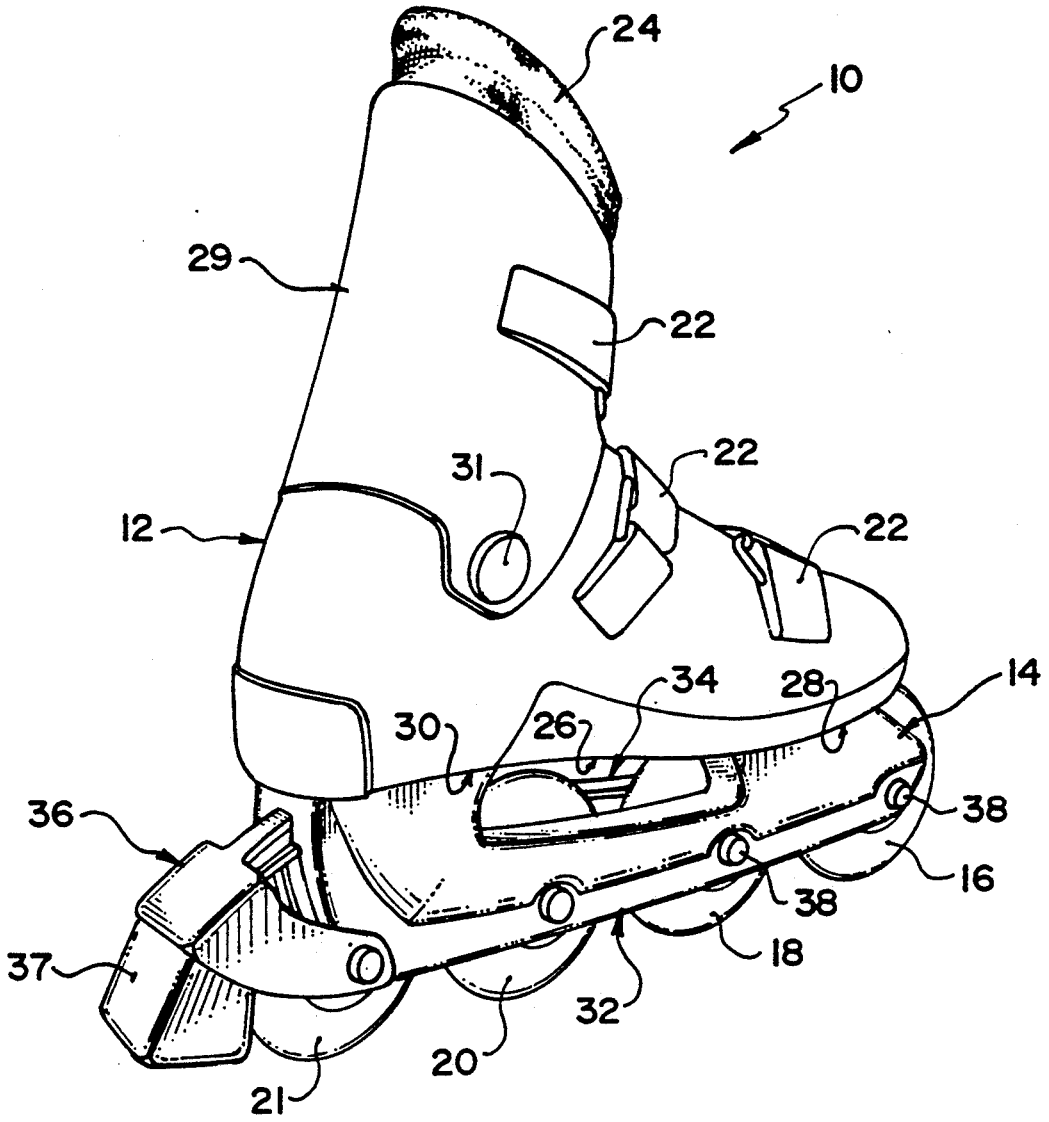
FIG. 1 illustrates a perspective view of a conventional in-line roller skate with four in-line wheels and a frame securing the wheels to a boot.

FIG. 1 illustrates in perspective view a conventional in-line roller skate 10. The skate 10 includes a boot 12 and a rigid wheel frame 14 attached on the underside thereof. Frame 14 retatably supports four in-line wheels which are identified from front to rear respectively as wheels 16, 18, 20 and 21. Frame 14 is attached to the under-sole 26 of boot 12 at a front sole attachment 28 and a rear sole attachment 30. Frame 14 includes parallel first and second side rails 32 and 34 respectively. Side rail 34 is partly visible in FIG. 1. The side rails 32 and 34 are used for mounting the axles of the wheels 16, 18, 20 and 21. Frame 14 may include at the rear a brake assembly 36 having a braking pad 37 which a skater may use to assist in stopping forward or reward motion, by pressing the pad against the ground.

Boot 12 includes an ankle cuff 29 which is pivotally attached to boot 12 by a cuff pivot point 31. Boot 12 further includes a plurality of boot closure means 22 for closely conforming the boot 12 to a skater's foot. As shown in FIG. 1, closure means 22 are individual buckle type closures, which are conventional- Other known means of tightening a boot onto a foot, such as laces and eyelets, or hook and pile fastener straps are also feasible and are within the scope of the present invention. Boot 12 may include a soft absorbent liner 24 which may be removable if desired.

Figure 2:
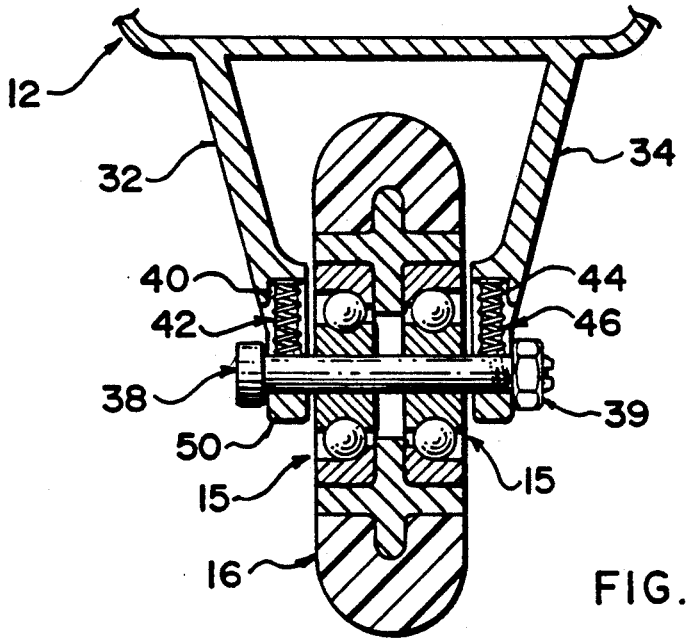
FIG. 2 illustrates a front partial section view of an in-line roller wheel, spring-mounted to a wheel carrying frame attaching the wheel and axle to the boot.

FIG. 2 illustrates a front partial section view of a wheel 16, which is rotatable on an axle 38. The axle 38 rotates in a pair of ball bearings 15 in the wheel 16, which is conventional. The bearings 15 reduce friction and minimize heat development when the wheels 16, 18, 20 and 21 rotate while the skater is skating. The axle 38 is held in place by nut 39. The first side rail 32 is constructed to include therein a vertical cavity 40 which can receive a coil spring 42. The top end of the coil spring 42 bears against the top of the cavity 40, which is slightly notched. At its lower end, the spring 42 bears against the top side of axle 38. The wheel 16 rotates on the axle 38 which is basically stationary- The second side rail 34 is constructed to have therein a similar second spring cavity 44 and a second coil spring 46. This construction with dual springs 42 and 46, one on each side of the wheel 16, enables wheel 16 to move upwardly or downwardly (depending upon the degree of softness of the springs 42 and 46) against the pair of springs 42 and 46 respectively when the wheel 16 contacts an obstruction or bump in the ground surface over which the skate is traversing. The construction also permits a slight amount of lateral tilting of the wheel 16, which can be controlled by the degree of stiffness of the coil springs 42 and 46.

The other three wheels illustrated in FIG. 1, namely, wheels 18, 20 and 21, are similarly equipped with corresponding coil springs and cavities in the side rails 32 and 34 in order to enable those wheels to also yield upwardly against the springs when bumps or obstructions are encountered on the ground surface. The springs 42 and 46, and the other springs, are selected to have sufficient compression force to carry the weight of the skater. The springs can be removed and replaced with springs of other compressive force to proportionately accommodate the weight of lighter or heavier skaters. Spring systems other than coil springs, for instance, resilient rubber blocks, or leaf springs may be used.

Figure 3:
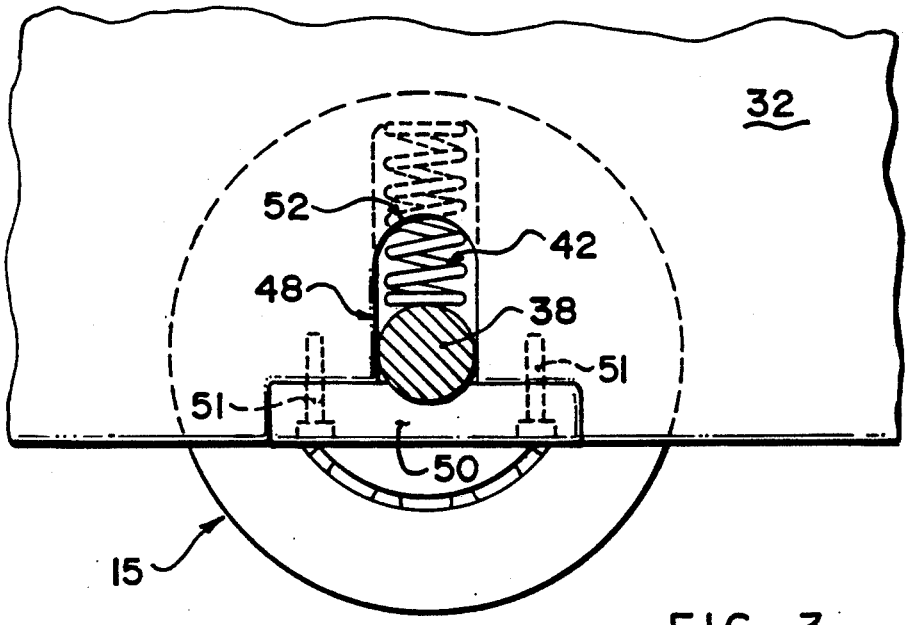
FIG. 3 illustrates a side view of a wheel bearing and axle, spring-mounted to a frame of an in-line roller skate.

FIG. 3 illustrates a side view of the axle 38, wheel bearing 15 and spring construction illustrated in FIG. 2 . In FIG. 3 , it can be seen that side rail 32 has formed therein a vertical longitudinal axle well 48, in which axle 38 and wheel 16 can move upwardly or downwardly within fixed limits. Forward or rearward movement of the axle and wheel a restricted. The downward movement of axle 38 and wheel 14 is restricted by cross bar 50. Bar 50 is held in place against rail 32 by a pair of counter sunk screws 51. Likewise, the upward movement of axle 38 and bearing is limited by the top 52 of well 48. As seen in FIG. 3, wheel 16 which rotates about axle 38 by means of the ball bearings 15, is free to move upwardly against the downward force exerted by coil spring 42, whenever the bottom of wheel 16 hits an obstruction in the ground surface over which the skater is skating. The distance of axle travel between bar 50 and the top 52 of well 48 is sufficient to enable the spring 42 to absorb the shock caused by most bumps encountered by the skater. While spring 42 is visible in FIG. 3 , as depicted, side rail 32 can be designed and formed (such as by injection molding) to provide a cover for spring 42, and well 48, so that they are not visible. This may be desirable for cosmetic or design reasons or retard inclusion of foreign particles.

As used in this disclosure the term "resilient material" means a material which is elastic, recoils. rebounds and resumes shape and size after being stretched or compressed under force.

Figure 4:
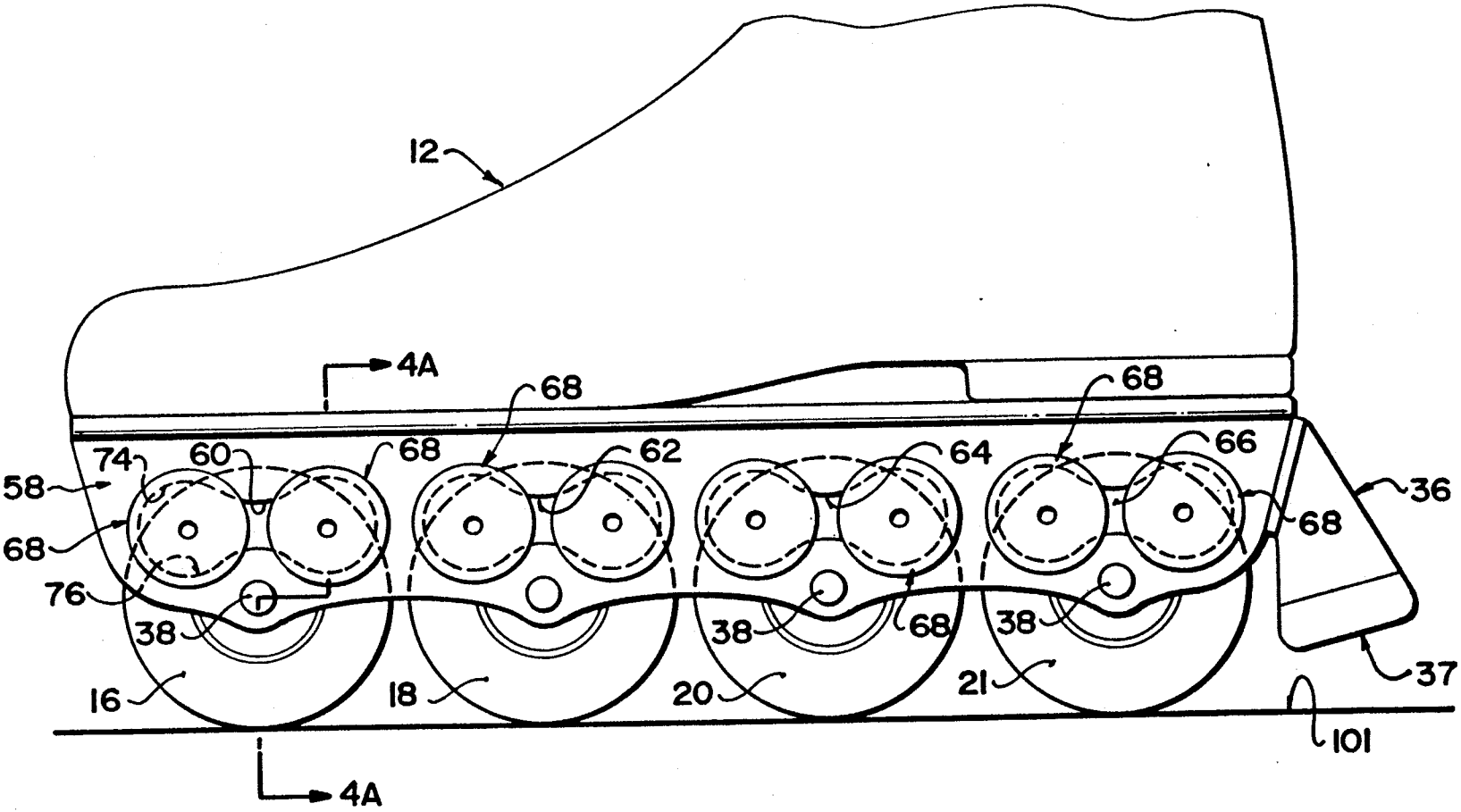
FIG. 4 illustrates a side view of a second embodiment of shock absorbent in-line roller skate and boot design comprising elastic discs and receptacles.

FIG. 4 illustrates a side view of a second embodiment of shock absorbent in-line roller skate and boot design. As with the previous design, the boot 12 (shown schematically) has four wheels 16, 18, 20 and 21 on the underside thereof, and a brake assembly 36 and pad 37 at the rear end thereof. However, in the second embodiment illustrated in FIG. 4, the pair of parallel side rails 56 and 58 (side rail 58 is visible in FIG. 4) have a different construction. The side rail 58 is typically constructed of a resilient strong material such as extruded high density polyethylene, polypropylene some other suitable material, (which can be reinforced with glass or graphite fibers) which provides both rigidity, strength and certain amount of flexibility. The material should be relatively rigid in the linear alignment direction and reasonably flexible in the vertical direction to prevent linear wobble of the wheels, but with vertical movement of the wheels. The side rail 58 is extruded to have formed therein a series of four dumbbell shaped openings, 60, 62, 64 and 66. The center of each dumbbell opening 60, 62, 64 and 66 is positioned above the axle 38 of the underlying wheel. The regions between the adjacent ends of each dumbbell opening 60 can be reinforced, if desired, to increase strength and rigidity.

Fitted in the large opening at each end of the dumbbell 60 are a series of spring plugs or discs 68 which are formed of a suitable compressible material, such as a polyurethane elastomer, or the like. These spring plugs or discs 68 act like compression springs and provide shock absorbing capacity to the wheels when the wheels contact bumps or uneven terrain. The spring discs 68 can be exchanged with either softer or firmer versions in order to provide the desired amount of shock absorbing or spring action to the dumbbell 60 and spring disc 68 combination. The elasticity of each disc can be individually selected to customize the bump absorbing action. The discs can have bright colors to give heightened consumer appeal.

FIG. 4A illustrates a section view taken along section-line 4A—4A of FIG. 4. In FIG. 4A, spring discs 68 are shown at each side. For purposes of illustration, a plug remover 69 and hooked rod 71 are shown removing (or installing) the disc 68 in the opening 60. The first side rail 56 extends downwardly from the boot 12 at the left side of the figure, while the parallel side rail 58 extends downwardly the right side of the figure. The dual side rail combination 56, 58 can be injection molded as a unit, and fiber reinforced, which is evident in FIG. 4A. The axle 38 extends through the base regions of the side rail combination 56, 58, and is secured with nut 39 on the opposite side. The axle 38, and nut 39 combination holds the wheel 16 in the interior opening provided by the parallel spaced side rails 56 and 58.

FIG. 4B illustrates, in section view, upper lip 74 and lower lip 76 which are formed in the upper and lower regions of the dumbbell opening 60. The upper lip 74 and lower lip 76 are designed to engage snuggly with the groove 78 which is formed around the periphery of the spring disc 68. In FIG. 4B, the upper lip 74 and lower lip 76 are shown having a rounded form, and the groove 78 in the spring disc 68 also has a congruent rounded form. However, the respective configurations can have different designs, for instance, square, triangular, dove-tail, and the like, if greater interaction between the groove 78 and the respective lips 74 and 76 is required. In FIG. 4B, no disc 68 is shown in the left side opening 60. This can be by design. As a rule, however, discs 68 are normally installed on both sides.

As seen in FIG. 4A, the spring disc 68 is in a non-compressed configuration. However, when the wheel 16 encounters a bump or an obstruction of some sort (level 102), the wheel 16 is forced upwardly as illustrated in FIG. 4B, which illustrates a section view taken along section line 4A—4A of FIG. 4, except in the depiction illustrated in FIG. 4B the roller wheel 16 is under upward compression. The initial position of wheel 16 is indicated by dashed lines 72. The upward movement of the wheel 16 forces the axle 38, nut 39 to move upwardly as indicated by dashed lines 73. As is evident in FIG. 4B, this upward action compresses dumbbell opening 60, and spring disc 68. Spring disc 68 absorbs the upward compressive force by contracting vertically and expanding laterally. A similar action would take place in a companion spring disc 68 if it were fitted in left dumbbell opening 60. The spring disc 68 has an opening 70 through the center thereof. The size of this opening 70 can be varied in order to provide increased control over compressibility of the spring disc 68. As a general rule, the larger the spool opening 70, the more resilient is the spring disc 68. However, compressibility is also governed by the degree of elasticity of the elastomeric material from which spring disc 68 is formed. The opening is also used to enable the disc 68 to be installed or removed by disc remover 69 as shown in FIG. 4.

Figure 4C:
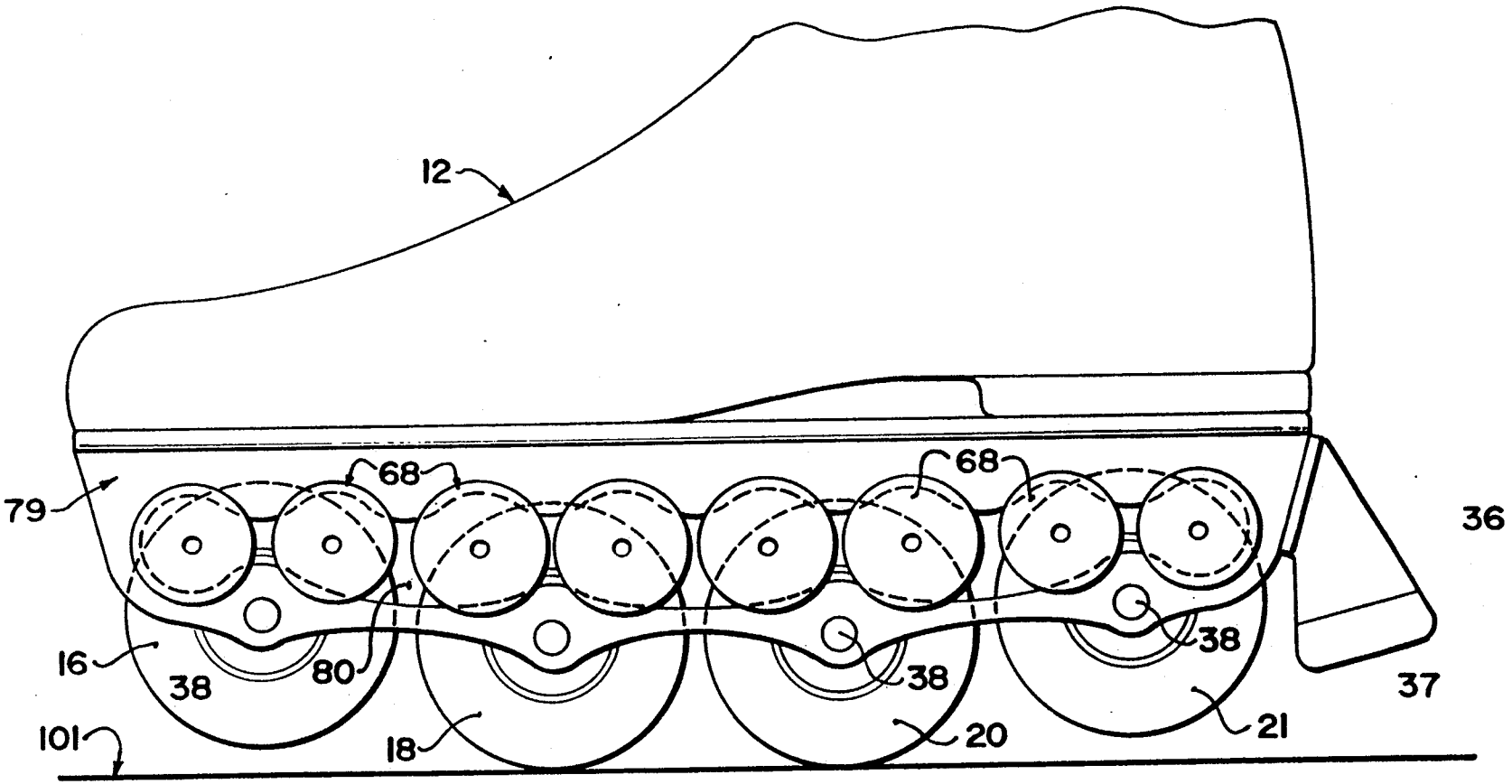
FIG. 4C illustrates a side view of a third embodiment of shock-absorbent in-line roller skate.

FIG. 4C illustrates a side view of a third embodiment of shock-absorbent in-line roller skate. As seen in FIG. 4C, the four wheels 16, 18, 20 and 21 are arranged in an arc configuration so, in the embodiment shown in FIG. 4C, only the two center wheels 18 and 20 touch the ground 101. In certain instances, for example, increased manuverability, may be desirable to have the forward wheel 16 and the rear wheel 21 raised above the two middle wheels 18 and 20. The forward wheel 16 and the rear wheel 28 would then only contact the ground under certain conditions. The side rail position linking the axles 38 can be designed to have a vertical bowing action, and a relatively rigid linear configuration. This region of the rail 79 can be post-tensioned or pre-tensioned, as required, in order to accommodate the elasticity of the discs 68.

As seen in FIG. 4C, the side rail 79, rather than having formed therein a series of four dumbbell openings, has formed therein a single continuous undulating "string of beads" type opening, in which the spring discs 68 are fitted. The discs 65 can have uniform or varying degrees of elasticity as required to provide the proper shock absorbency action. The central discs can be of a larger diameter than the end discs. As with the design illustrated previously in FIG. 4, there is a pair of spring discs 68 for every wheel and axle combination. Again, the side rails 58 and 56 (not visible) are formed of appropriate resilient material to provide a certain amount of flexibility, so that the dimensions of the continuous undulating opening 80 will compress upwardly to a certain extent, when the wheels 16, 18, 20 and 21 impact the ground. The compression action of the opening 80, however, is controlled both by the degree of resiliency of pre or post-tensioning of the linking area between the axles 38 and by the degree of compressibility provided by the spring discs 68.

Figure 4D:
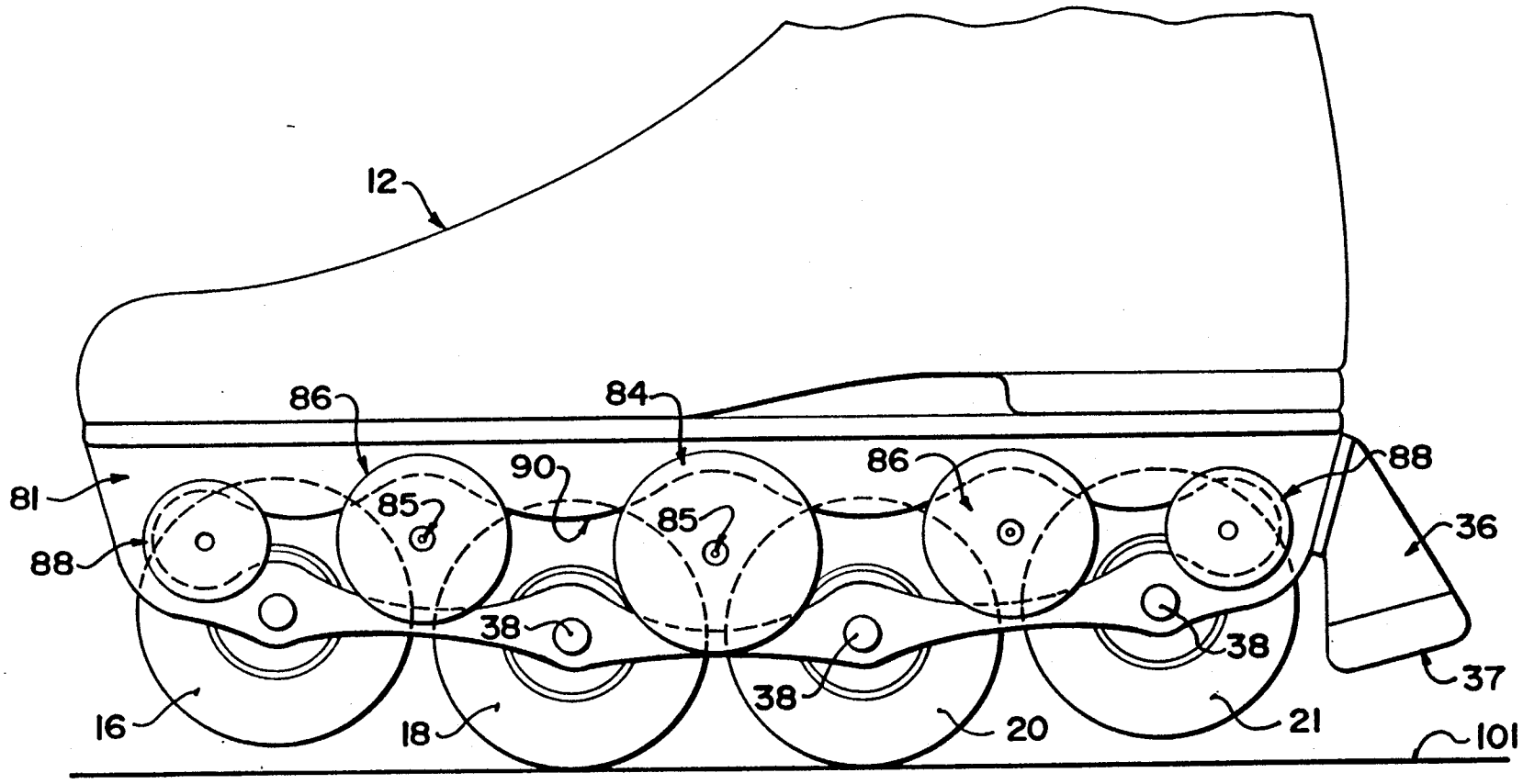
FIG. 4D illustrates a side view of a fourth embodiment of shock-absorbent in-line roller skate.

FIG. 4D illustrates a side view of a fourth embodiment of shock-absorbent in-line roller skate. The design illustrated in FIG. 4D is similar to a certain extent to that illustrated in FIG. 4C, except that the undulating opening 90, is formed (or deformed by pre or post-tensioning) so that it accommodates significantly different sizes of spring discs. Also, the middle three discs 86 as seen in FIG. 4D have air valves so that the internal air pressure can be adjusted. As seen in FIG. 4D, there are five spring discs, arranged so that they fit on the outsides and the interiors of the four axles of the four wheels 16, 18, 20 and 21. A single large size hollow air filled spring disc 84 is fitted into the central portion of the opening 90, between the middle wheels 18 and 20. A pair of medium size air filled spring discs 86, are fitted between the two forward wheels 16 and 18, and the latter two wheels 20 and 21. A pair of small exterior spring discs 88, are fitted in the two ends of the opening 90. The action provided by the embodiment illustrated in FIG. 4D is similar to that provided by the previous embodiments, but represents a alternative means of achieving the shock absorbent, compressible wheel design provided by the invention.

Figure 4E:
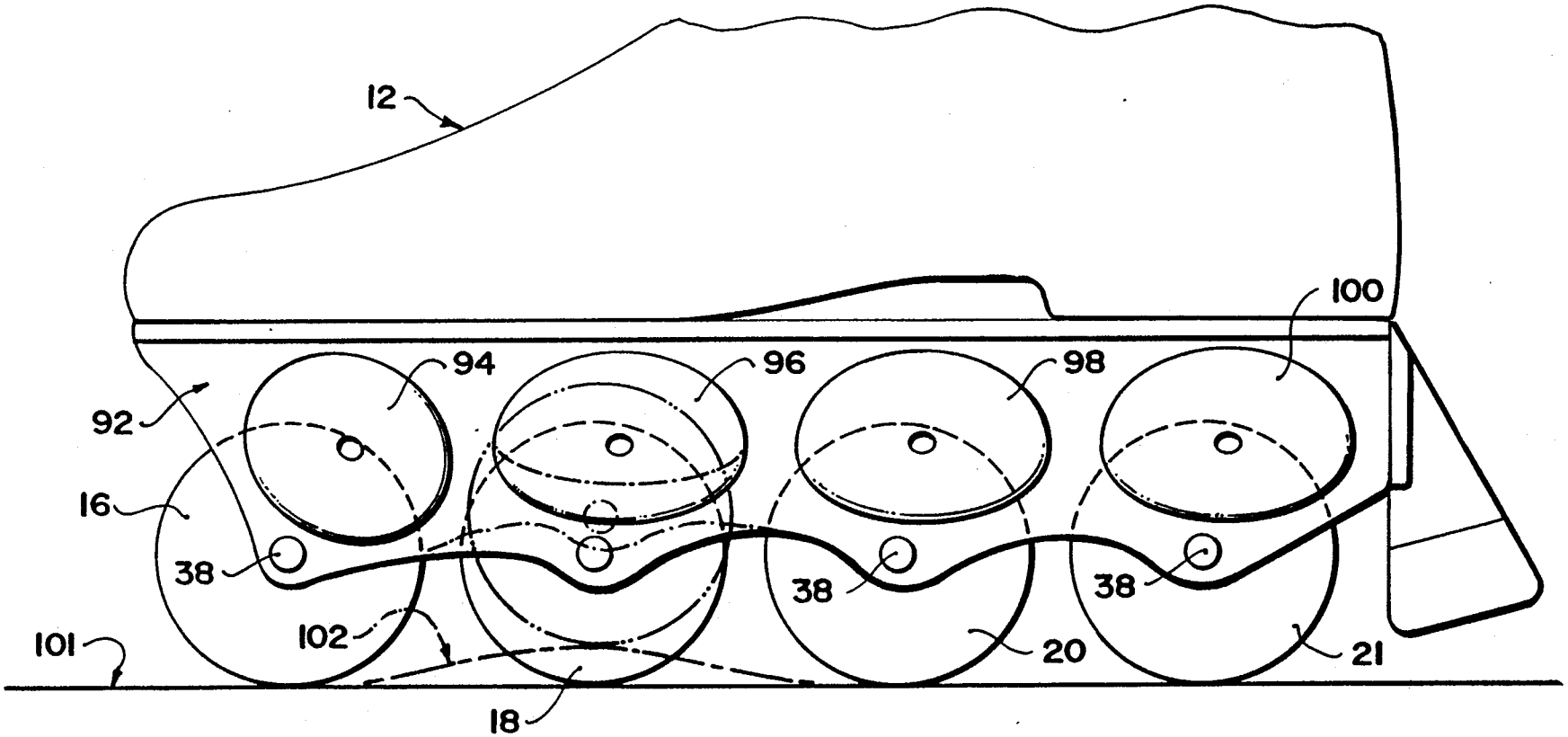
FIG. 4E illustrates a side view of a fifth embodiment of shock-absorbent in-line roller skate.

FIG. 4E illustrates a side view of a fifth embodiment of shock-absorbent in-line roller skate. As seen in FIG. 4E, four discs, 94, 96, 98 and 100, are fitted in oval openings formed in side rail 92. The four discs, 94, 96, 98 and 100 are positioned above and slightly to the rear of the respective axles 38 of the respective wheel 16, 18, 20 and 21. However, to provide the shock absorbing capacity along the force line that would be generated by wheel 16 impacting a bump, or the like, the front spool 94 is positioned slightly farther behind axle 38 of front wheel 16, than with the other three discs.

FIG. 4E illustrated by means of dashed lines 102, the manner in which wheel 18 reacts when it impacts a bump indicated by dashed line 102. The wheel 18 moves upwardly, thereby compressing disc 96, into a more oval shape configuration. A resiliency of the disc 96 absorbs the upward compressive force, and thereby enables wheel 18 to negotiate the bump 102 readily.

FIG. 4F illustrates a perspective view of resilient shock absorbent spring disc 68. The spring disc 68 has a general disc-like configuration, with a peripheral groove 78 around its circumference. Disc opening 70 is also indicated in the central area of the spring disc 68, and penetrates through the interior of the spring disc 68. This opening 70 can vary in size in order to regulate the degree of elasticity of the disc 68. It can also be used to receive plug remover 69 for installation or removal on the skate rail.

FIG. 4G illustrates a partial section view of a sixth embodiment of the invention with air filled discs. The discs 77 are at an angle and are hollow so that they can be air filled via valves 85. The air can be pumped in by pump 78 and needle 83. The manner in which the discs compress when wheel 16 contacts a bump 102 is indicated in dashed lines. The pump 78 can be of small size and clamped to boot 12.

Figure 5A:
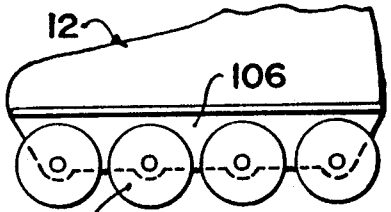
FIG. 5A illustrates a side view of the dual wheel in-line roller skate illustrated in FIG. 5.
Figure 5:
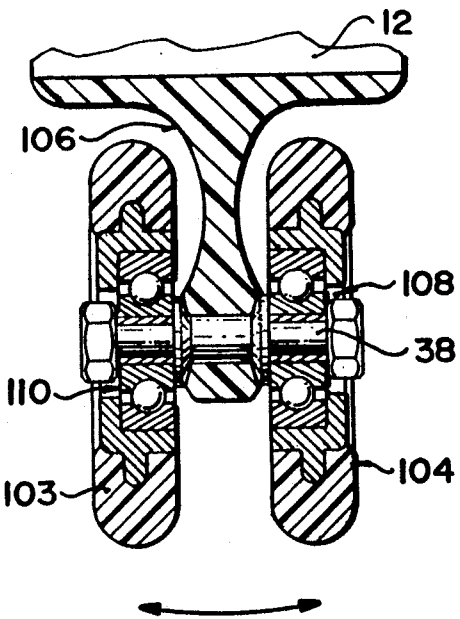
FIG. 5 illustrates an end section view of a first embodiment of a dual wheel in-line roller skate.

FIG. 5 illustrates an end section view of a dual wheel in-line roller skate. The boot 12 as seen in FIG. 5 has on the underside thereof two parallel rows of wheels 102 and 104 mounted by axle 38 to a central mount 106. This dual wheel in-line roller skate design is also adapted to absorb shocks and bumps as will be explained below.

In the end section view illustrated in FIG. 5, the first wheel 102 is paired with a second wheel 104, both of which are rotatably mounted on a common axle 38, and are rotatable about respective ball bearings 108 and 110. The pair of wheels 102 and 104 are fixedly mounted on a central dual wheel mount 106, which is secured to the undersigned of the boot 12. The central dual wheel mount 106 is constructed, such as by extrusion molding, from a strong semi-rigid material which has a certain amount of lateral "give" to it. The degree of stiffness of the material from which the wheel mount 106 is constructed can be varied as required. Reinforcing with glass or graphite fibers may be advisable. FIG. 5A illustrates a side view of the dual wheel construction with four pair of wheels 102 mounted in spaced relation rotatably on central dual wheel mount 106, which is secured to the underside of boot 12.

As indicated by the double ended arrow in FIG. 5, the pair of wheels 102 and 104 can move laterally due to the semi-flexibility of the central dual wheel mount 106. This action enables each wheel 102 and 104 to negotiate individually a bump or an obstruction. The result is that the four pair of wheels on the skate (see FIG. 5A) are adapted to yield to obstructions on the surface over which the skater is travelling.

Figure 6A:
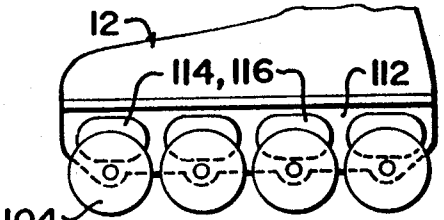
FIG. 6A illustrates a side view of the dual wheel in-line roller skate illustrated in FIG. 6.
Figure 6:
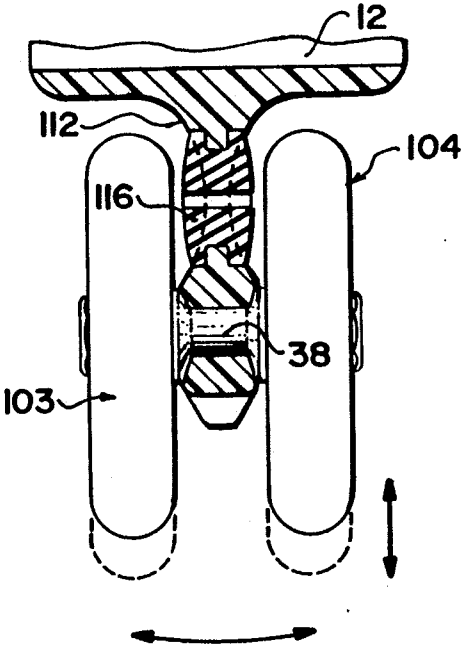
FIG. 6 illustrates an end-section view of a second embodiment of a dual wheel in-line roller skate.

FIG. 6 illustrates and end section view of the second embodiment of the dual wheel in-line roller skate. FIG. 6A illustrates a side view of the dual wheel in-line roller skate illustrated in FIG. 6. The dual wheel design illustrated in FIGS. 6 and 6A vary from that illustrated in FIGS. 5 and 5A in that the central mount 112 has formed therein a plurality of openings 114, into which can be fitted resilient spring discs 116. The action provided by this combination is similar to that described previously for the openings and the spring disc combinations described for the single in-line roller skate designs illustrated in FIGS. 4, 4A, 4B, 4C, 4D, 4E, 4F and 4G.

The configuration illustrated in FIG. 6 and 6A enables lateral movement and vertical wheel movement to be achieved, as indicated by the pair of double headed arrows.

Figure 7A:
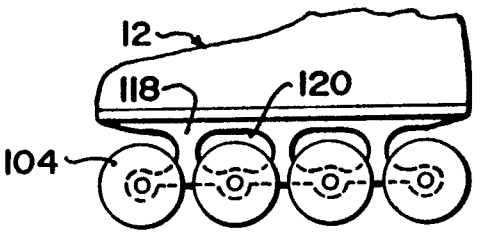
FIG. 7A illustrates a side view of the dual wheel in-line roller skate illustrated in FIG. 7.
Figure 7:
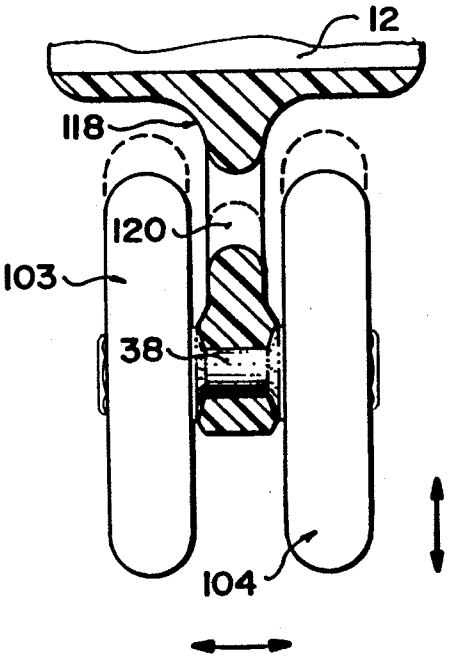
FIG. 7 illustrates a end-section view of a third embodiment of a dual wheel in-line roller skate.

FIG. 7 illustrates an end section view of a third embodiment of a dual wheel in-line roller skate. FIG. 7A illustrates a side view of the roller skate design illustrated in FIG. 7. In this design, the central wheel mount 118 has an "open-ended" design, with two central openings 120. This design also has lateral and vertical dual wheel movement, as indicated by the pair of double headed arrows in FIG. 7. The material from which central mount 118 is constructed can be selected to provide the requisite amount of flexibility and shock absorbing capacity. A semi-rigid resilient plastic material such as density polyethylene, high density polypropylene, suitable reinforced with fiberglass or graphite filaments, or the like, can be utilized.

FIGS. 5, 5A, 6, 6A, 7 and 7A illustrate three embodiments of dual wheel in-line roller skate design, wherein the wheels are mounted in pairs. In each case, the pair of wheels can move upwardly or downwardly by compressing the openings or in a lateral direction about the central dual wheel mount which is constructed of a suitable resilient material.

Most bumps and obstructions encountered by a skater as he or she skates over the ground are not very large and accordingly it is unlikely that each of the dual wheels will encounter the same bumps simultaneously. Thus, when one of the dual wheel pairs encounters a bump, it is able to move upwardly relative to the other dual wheel, and thereby absorb at least a portion of the impact caused by the bump. The pair of wheels are also able to move laterally. This pivotal dual wheel configuration provides a more smooth operating and shock absorbing in-line skate design, than the conventional in-line roller skate design where the wheels are rigidly mounted to the frame.

With the dual wheel mounting, one or both of the wheels are free to move upwardly against the compression force exerted by the central mound, with or without spring discs, when one or both wheels encounter a bump or obstruction the ground surface over which the skater is skating. This construction provides a very smooth operating dual wheel in-line roller skate. Furthermore, when the skater negotiates a turn, and "leans" into the turn, the wheel mounting flexes somewhat and enables the inner wheel to yield more than the outer wheel, as the case may be, thereby enabling all wheels to remain in contact with the ground surface, even though the skater is leaning into the turn.

Figure 8:
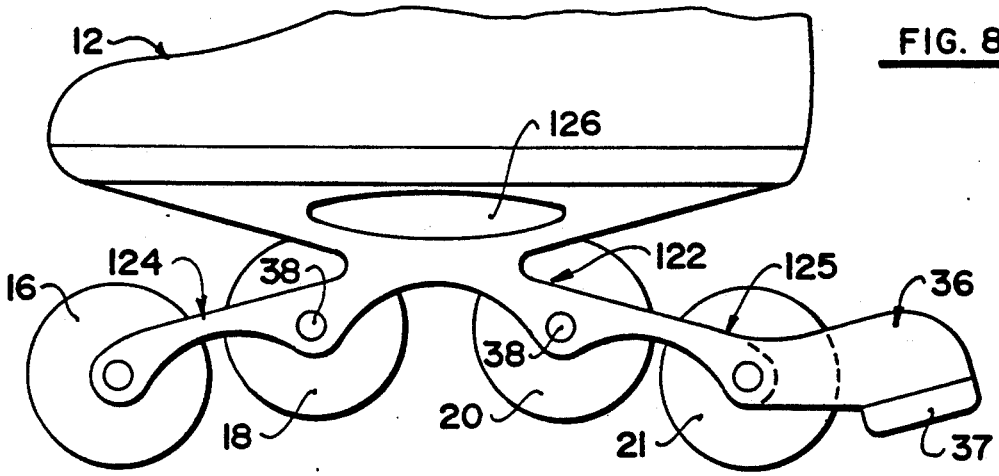
FIG. 8 illustrates a side view of an in-line roller skate with spring yoke wheel suspension.

FIG. 8 illustrates a side view of an in-line roller skate with spring yoke wheel suspension. In this design, the four wheels 16, 18, 20 and 21, are mounted on a yoke-like wheel suspension 122, which is secured to the underside of the boot 12. FIG. 8 illustrates the arrangement the wheels and the yoke 122, which is constructed of a semi-ridge spring-line resilient material, such as flexible metal alloys, graphite fiber, or similar material, used in bicycle forks and frames, tennis rackets, or similar sports equipment constructions. The front pair of wheels 16 and 18 are mounted on the forward portion 124 of the yoke. Wheels 20 and 21 are rotatably mounted on the rear portion of the yoke 122.

Figure 8A:
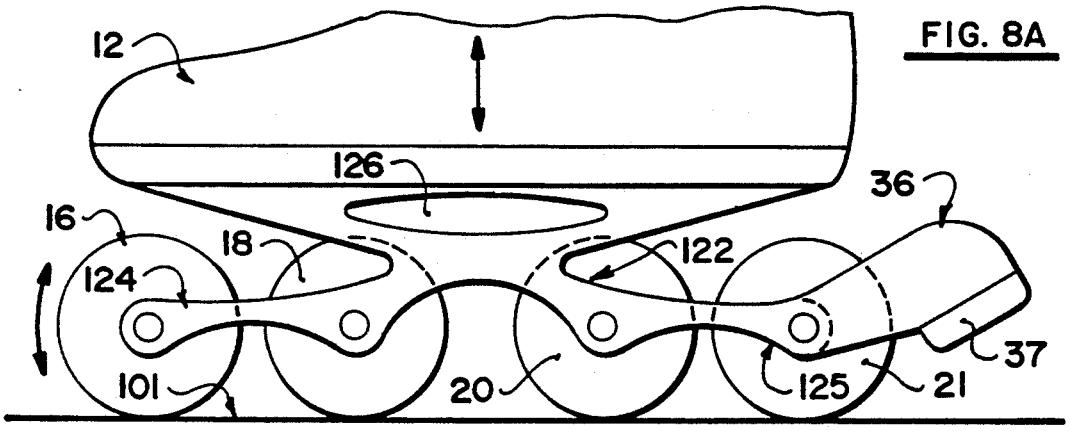
FIG. 8A illustrates a side view, when contacted with the ground and under a certain load.
Figure 8B:
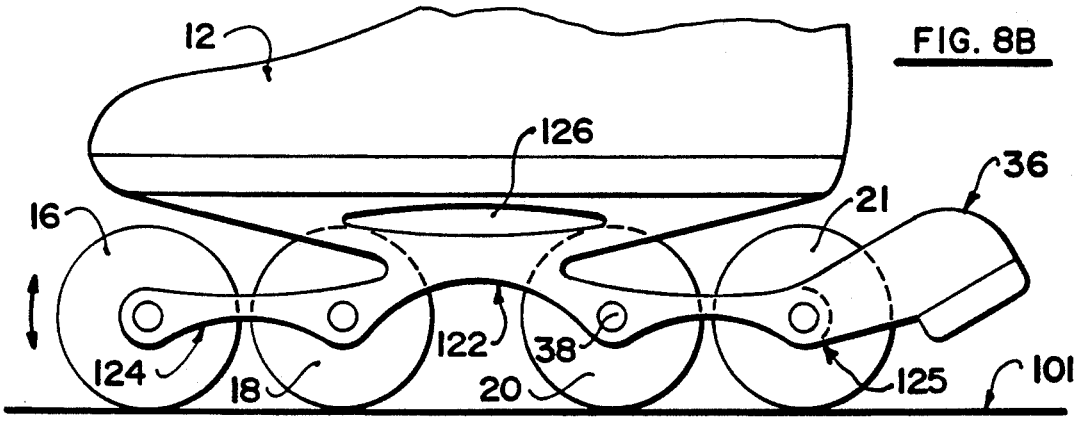
FIG. 8B illustrates a side view when subjected to further ground compression action, compared to the configuration illustrated in FIG. 8A.

When the skater wearing the boot 12, contacts the ground, the forward and rear arms 124 and 125 of the yoke 122 yield upwardly as illustrated in side view perspective in FIG. 8A. This action is illustrated by the vertical double headed arrow on boot 12. As the skater applies more weight, the yoke 122, by means of the compression action provided by elongated oval opening 126, provides further shock absorbing and compression force absorbing action as seen in FIG. 8B. The in-line roller skate design illustrated in FIG. 8, 8A and 8B by selecting the appropriate constructing material for the yoke 122, can provide a cushioning-type action to the skate.

Figure 9:
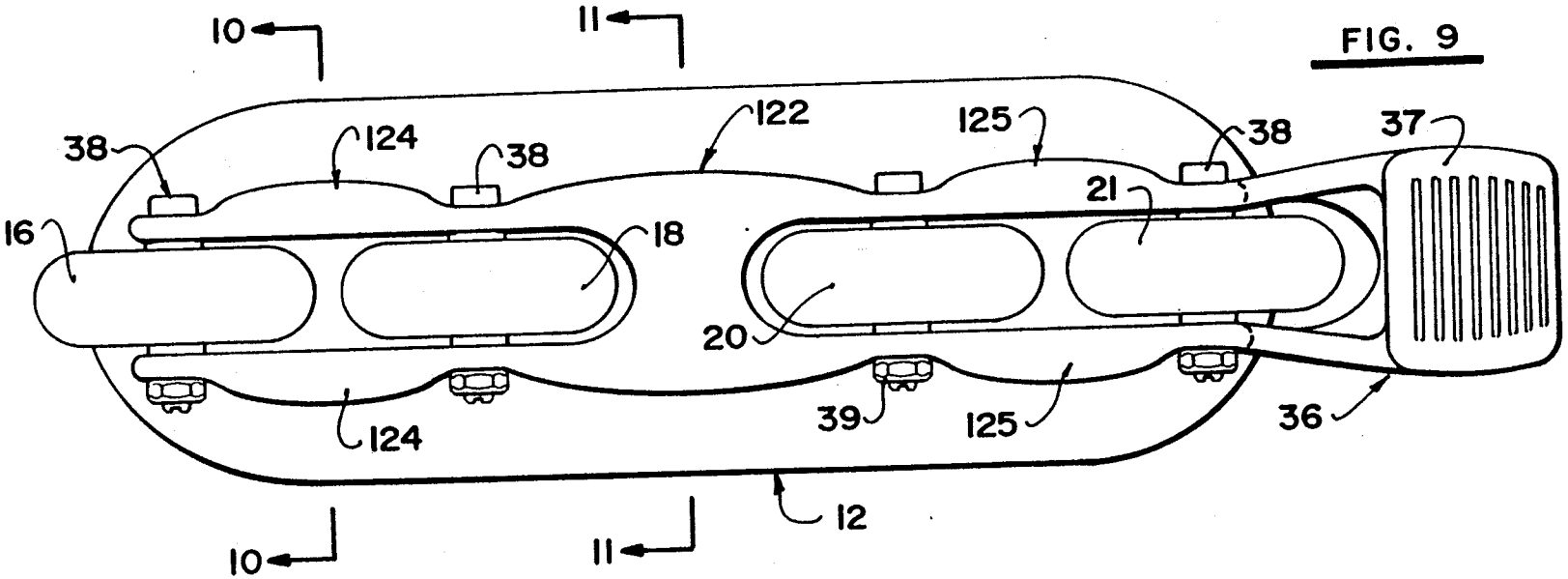
FIG. 9 illustrates a bottom view of an in-line roller skate with spring yoke wheel suspension.

FIG. 9 illustrates a bottom view of an in-line roller skate with spring yoke wheel suspension, as illustrated FIGS. 8, 8A and 8B. The forward arm 124 of the yoke and the rear arm 125 of the yoke 122 are forked, thereby providing openings in the interior in which the wheels 16, 18, 20 and 21 can be rotatably mounted respectively by axles 38.

Figure 11:
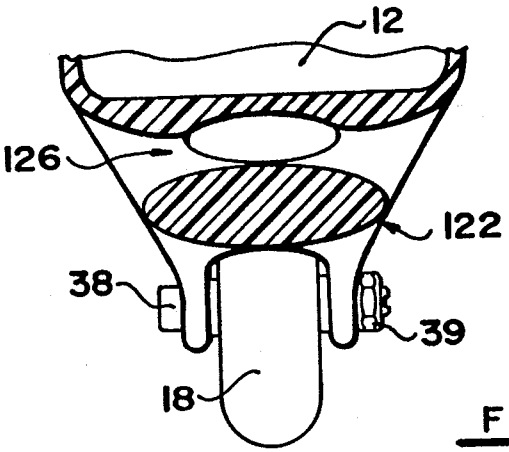
FIG. 11 illustrates a section view taken along section 11—11 of FIG. 9.
Figure 10:
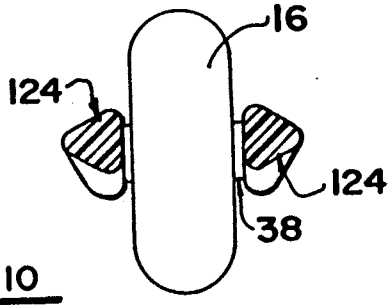
FIG. 10 illustrates a section view taken along section 10—10 of FIG. 9.

FIG. 10 illustrates a section view taken along section 10—10 of FIG. 9. The wheel 16 is shown rotatably mounted on axle 38, which is held by forward yoke arm 124. FIG. 11 illustrates a section view taken along section 11—11 of FIG. 9. Wheel 18 is rotatably mounted on axle 38, nut 39 combination, which is mounted in yoke 122. The opening 126 is also indicated. The yoke 122 is secured to the underside of the boot 12.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. An in-line roller skate comprising (a) a boot with a heel, arch and toe adapted to receive a foot of a skater;

(b) a first wheel supporting rail means secured to an underside of the boot and extending from the heel to the toe of the boot, and having at least one first cavity therein;

(c) a second wheel supporting rail means secured to an underside of the boot, adjacent and parallel to the first rail and having at least one second cavity therein;

(d) at least three wheel means mounted in tandum in a line between the first and second rail means, the three wheel means being respectively connected to the first and second rail means by respective axles and bearings, the first cavity being located between the boot and the axles and bearings associated with the first rail means, and the second cavity being located between the boot and the axles and bearings associated with the second rail means; and (e) first disc-shaped resilient shock absorbing means located in the first cavity between the axles and bearings and the first rail means connecting to the boot and second disc-shaped resilient shock absorbing means located in the second cavity between the axles and bearings and the second rail means connecting to the boot to enable the respective three wheel means to move upwardly or downwardly relative to the boot and the first and second rail means.

2. A roller skate as claimed in claim 1 wherein at least three spring cavity means are formed in the first rail means and at least three cavity means are formed in the second rail means, the cavity means coinciding with the positions of the three wheel means respectively, each cavity means being adapted to receive disc-like resilient shock absorbing means.

3. A roller skate as claimed in claim 2 wherein four wheel means are rotationally mounted between the first rail means and the second rail means.

4. A roller skate as claimed in claim 3 wherein four resilient shock absorbing means are mounted in four respective cavities formed in the first rail means, and four resilient shock absorbing means are mounted in four respective cavities formed in the second rail means.

5. A roller skate as claimed in claim 4 wherein the eight resilient shock absorbing means fit in eight cavities in the respective first and second rail means associated with the axles and bearings of the four wheels.

6. A roller skate as claimed in claim 1 where in the first and second rail means are unitarily constructed.

7. A roller skate as claimed in claim 2 wherein the resilient shock absorbing means are formed in the shape of discs which have peripheral grooves around the circumference thereof which discs are positioned in the respective cavity means in the first rail means and second rail means, the discs impinging on the axle and bearing means for each respective wheel means, and absorbing compression force when the respective wheel means moves upwardly, and dispensing compression force when the respective wheel means moves downwardly.

8. A roller skate as claimed in claim 7 wherein the first rail means and the second rail means have formed therein, in association with the respective cavity means, axle wells, which permit the axles to move upwardly or downwardly in relation to the first and second rail means.

9. An in-line roller skate comprising:

(a) a boot with a heel, arch and toe adapted to receive a foot of a skater;

(b) a resilient wheel mounting means secured to the underside of the boot, longitudinal with the boot, and having a elongated longitudinal wheel receiving cavity therein to form first and second longitudinal side walls; with at least one opening formed in the first side wall of the wheel mounting means, and at least one opening formed in the second side wall of the wheel mounting means;

(c) a plurality of wheels rotatably mounted in series within the wheel receiving cavity; and (d) a removable resilient compression force disc-like absorbing means fitted in the first opening in the wheel mounting means, and a removable resilient compression force disc-like absorbing means fitted in the second opening in the wheel mounting means.

10. A roller skate as claimed in claim 9 wherein four wheels are mounted in series and four openings are formed in each wall of the wheel mounting means on either side of the wheel receiving cavity, the eight openings being adapted to receive respective detachable resilient disc-shaped compression absorbing means.

11. A roller skate as claimed in claim 10 wherein the detachable resilient compression receiving means are formed in the shape of discs which have peripheral grooves around the circumference thereof, the peripheral grooves being adapted to fit with respective edges of the openings.

12. A roller skate as claimed in claim 11 wherein each wall of the wheel mounting means has formed therein a four openings, each opening receiving a pair of resilient disc-like compression absorbing means.

13. A roller skate as claimed in claim 12 wherein the disc-like resilient compression force absorbing means have compressible openings therein.

14. A roller skate as claimed in claim 12 wherein the disc-like resilient compression force absorbing mans are hollow.

15. A roller skate as claimed in claim 13 wherein the wheels have rotatable bearings therein and are mounted on axles which are secured to the side walls of the wheel supporting means.

16. A roller skate as claimed in claim 14 wherein a pair of disc-like resilient compression absorbing means are detachably fitted to the wheel mounting means for every axle.

* * * * *